US010336508B2

(12) United States Patent
Battaglia

(10) Patent No.: US 10,336,508 B2
(45) Date of Patent: Jul. 2, 2019

(54) RESEALABLE COVER FOR CONTAINERS

(71) Applicant: William Battaglia, North Haledon, NJ (US)

(72) Inventor: William Battaglia, North Haledon, NJ (US)

( * ) Notice: Subject to any disclaimer, the term of this patent is extended or adjusted under 35 U.S.C. 154(b) by 128 days.

(21) Appl. No.: 15/453,671

(22) Filed: Mar. 8, 2017

(65) Prior Publication Data

US 2018/0132640 A1 May 17, 2018

Related U.S. Application Data

(60) Provisional application No. 62/421,161, filed on Nov. 11, 2016.

(51) Int. Cl.

| | |
|---|---|
| ***B65D 43/02*** | (2006.01) |
| ***B65D 43/16*** | (2006.01) |
| ***B65D 51/00*** | (2006.01) |
| ***B65D 55/16*** | (2006.01) |

(52) U.S. Cl.

CPC ..... *B65D 43/022* (2013.01); *B65D 43/16* (2013.01); *B65D 51/007* (2013.01); *B65D 55/16* (2013.01)

(58) Field of Classification Search

CPC .. A47G 19/2272; B65D 55/16; B65D 51/007; B65D 43/16; B65D 43/022

USPC ..... 220/269, 4.23–4.25, 375, 839, 254.3; 215/235, 237, 320; 222/556

See application file for complete search history.

(56) References Cited

U.S. PATENT DOCUMENTS

| | | | | | |
|---|---|---|---|---|---|
| 2,690,861 | A | * | 10/1954 | Tupper | B65D 47/148 16/225 |
| 2,889,087 | A | * | 6/1959 | Paull | B65D 51/04 220/254.3 |
| 3,419,181 | A | * | 12/1968 | Stec | B65D 47/141 220/258.2 |
| 3,977,563 | A | | 8/1976 | Holt | |
| 4,310,102 | A | * | 1/1982 | Walter | B65D 23/003 215/250 |
| 4,415,097 | A | | 11/1983 | Meins | |
| 4,883,192 | A | * | 11/1989 | Krugman | B65D 25/48 220/711 |
| 4,948,009 | A | | 8/1990 | Sawatani | |
| 5,088,614 | A | | 2/1992 | Dumestre | |

(Continued)

FOREIGN PATENT DOCUMENTS

CN 105923250 9/2016

*Primary Examiner* — James N Smalley

(74) *Attorney, Agent, or Firm* — Sand, Sebolt & Wernow Co., LPA

(57) ABSTRACT

A cover for sealing a container having an interior chamber that holds a quantity of material therein. A first channel provided on a base of the cover receives a rim on the container's side wall. A first sealing member is provided on the base. A second sealing member provided on the lid is complementary to the first sealing member and is engageable therewith when the lid is moved to a closed position. A flexible bridge extends between the base and the lid. One of the first or second sealing members is a protrusion and the other is a second channel. The protrusion may be received within the second channel when the lid is closed. Pressure may be progressively applied to the lid to zipper the cover into a sealed position. When the lid is in the sealed position material cannot be accidentally or purposefully removed from the interior chamber.

14 Claims, 14 Drawing Sheets

(56) References Cited

U.S. PATENT DOCUMENTS

| | | | | |
|---|---|---|---|---|
| D353,328 | S | 12/1994 | Nuffer | |
| 5,562,205 | A | 10/1996 | Diaz | |
| 5,695,084 | A | 12/1997 | Chmela et al. | |
| 5,695,086 | A | 12/1997 | Viola | |
| 5,975,346 | A * | 11/1999 | Imperato | B44D 3/123 220/284 |
| D534,420 | S * | 1/2007 | Fager | D9/420 |
| 7,644,832 | B1 | 1/2010 | Tsengas et al. | |
| 8,720,740 | B2 | 5/2014 | Bratsch | |
| 2007/0257037 | A1 | 11/2007 | Scarborough | |
| 2009/0084753 | A1 * | 4/2009 | Ramos | B29C 45/1418 215/346 |
| 2012/0073997 | A1 | 3/2012 | Borg | |
| 2012/0181280 | A1 * | 7/2012 | Barbier | B65D 43/162 220/269 |
| 2013/0134165 | A1 * | 5/2013 | Ciccotelli | B65D 51/16 220/260 |

* cited by examiner

RESEALABLE COVER FOR CONTAINERS

CROSS REFERENCE TO RELATED APPLICATIONS

This application claims the benefit of U.S. Provisional Application Ser. No. 62/421,161 filed on Nov. 11, 2016, the entire disclosure of which is incorporated herein by reference.

BACKGROUND

Technical Field

The present invention relates generally to containers for materials. More particularly, the present invention is directed to cans or containers for holding beverages, foods or other substances and materials. Specifically, the present invention is directed to a cover that may be used to reseal an opened can or container; where the cover includes a base that engages an upper rim on the can or container and a lid that is movable to a position vertically over the base; and where a first sealing member on the base is engaged with a complementary second sealing member on the lid and pressure is applied progressively around a perimeter of the lid to seal the lid to the base.

Background Information

Food and beverages are frequently placed and sealed in metal cans to preserve them for long periods of time. One of the issues with this method of preservation is that cans typically are fabricated so that a section of the can is removed in order to gain access to the food or beverage placed therein. Once the section of the can is removed, the food or beverage must be consumed within a fairly short period of time or the contents of the can must be thrown away.

One of the issues with keeping an open food or beverage container around for even a few days is that the food or beverage therein is open to the air. In the case of a beverage this can lead to loss of carbonation in a very short time. In the case of a food substance (whether for human or animal consumption), the open can may lead to the food substance drying out very quickly. Additionally, there is also the possibility that the can may be knocked over and the contents be spilled therefrom. Furthermore, leaving the can open can also provide access for insects such as flies and bees. Contact with flies, for example, may lead to contamination of the food or beverage. Contact with bees in an open beverage can, for example, may result in a person being stung when they drink from the can.

One of the solutions that has commonly been used is that a consumer will place a piece of plastic film or wrap over the top of the food or beverage can. While this solution may slow down the loss of carbonation from a beverage and prevent spillage therefrom to a limited extent, the seal around the plastic film may not be adequate to prevent spillage or ingress of insects. This is because plastic films have a tendency not to stick very well and therefore can easily slide off the top of the can or container.

A number of solutions to this problem have been proposed in the prior art. For example, U.S. Design Pat. No. D353,328 (Nuffer) is directed to a pop or soda can cover that includes a lower portion that is presumably engageable around an upper end of the can, and an upper portion that is connected to the lower portion by a living hinge. The upper portion is selectively movable into a position where it presumably slides around an exterior surface of the lower portion to close off access to the interior of the can. A flange is provided on the upper portion to enable the user to move the lid back to an open position. While the can cover can close off access to the beverage retained within the can, the can is by no means sealed. Tipping the can upside down will cause liquid to leak between the contact regions of the upper and lower portions and it is likely the upper portion will be moved back to an open position by the weight of liquid pushing thereon when the can is inverted.

U.S. Pat. No. 4,415,097 (Meins) discloses a plastic cover for a beverage can that snap-fits over the upper rim of the can. The cover includes a collapsible straw that is positionable over an opening in the can. The straw may be moved to an extended position to allow a user to drink from the can; and the straw may be moved to a collapsed position when the straw is not required. The cover is rotated in order to move the straw out of alignment with the opening and thereby close off access to the contents of the can. It will be appreciated that while the rotated cover closes off access to the opening in the can, liquid can still escape from the can's opening and become trapped between the top of the can's metal lid and the plastic cover. This liquid may then cause issues when the straw is realigned with the can opening or may leak out from the perimeter of the lid.

U.S. Pat. No. 4,948,009 (Sawatani) is a plastic lid for a cup. This lid includes a central aperture that has flaps that extend across the aperture initially and are pushed out of the way when a straw is inserted through the aperture. The flaps aid in somewhat closing off parts of the aperture that are located around the exterior of the straw but does not seal around the straw.

U.S. Pat. No. 5,695,084 (Chmela et al) discloses a cover that has an eating utensil engaged with the cover via a living hinge. The cover includes a rim that snap-fits onto a can and when the rim is so engaged, a top wall of the cover extends across an opening to the interior of the can. The cover is designed so that, initially, the eating utensil will be folded inwardly under the top wall of the cover so that the eating utensil is positioned between the top wall of the cover and the top wall of the can. The cover is removed from the can, the can is opened by removing its top wall; the eating utensil is detached from the cover and is used to eat some of the contents of the can. The cover may be placed back on the can to close off access to the interior of the can.

U.S. Pat. No. 5,695,086 (Viola) discloses a can cover that is specially designed to have the appearance of an animal. The cover is designed to close off access to the interior of cans of pet food. The cover includes flanges to pull the cover off the can to regain access to the interior. The bottom surface of the cover is profiled in a similar manner to the profile of an upper end of the can and has a plurality of different engaging rings to allow the cover to be used on a number of differently sized cans of pet food.

U.S. Pat. No. 7,644,832 (Tsengas et al) discloses a lid for a can of pet food that includes a flange that may be grasped to pull the lid off the can. The lid also includes a slot through which a handle of a spoon may be engaged so that the scoop region of the spoon is received within the interior of the can.

Bratsch (U.S. Pat. No. 8,720,740) discloses a two part sealing lid for a beverage container. The first part of the lid is seated within the opening to the can and seals the can. This first part is secured to the can by snap hooks that are integrally formed with the cover and are configured to engage a flanged edge of the can. An outlet is provided in the first part of the lid and through which the contents of the can may be accessed. The second part of the lid is a cover that is twisted relative to the first part to close off access to the outlet or permit access to the outlet. A seal is provided between the first and second parts of the lid.

Scarborough (U.S. Patent No. 2007/0257037) discloses a beverage can resealing machine that has a body that conforms to the top of a can. There are two openings in the top wall of the body and a U-shaped metal rod that includes a pivotable member. The pivotable member engages the ceiling of the can and is movable in a first direction to allow liquid to flow from the can and in a second direction to seal the can. One of the biggest issues with this device is that it is quite complex and likely expensive to fabricate.

SUMMARY

There remains a need in the art for a simple but effective device for sealing opened beverage containers and cans for food, pet food or other substances or materials.

A cover for sealing a container having an interior chamber that holds a quantity of material therein is disclosed herein. A first channel provided on a base of the cover receives a rim on the container's side wall. A first sealing member is provided on the base. A second sealing member provided on the lid is complementary to the first sealing member and is engageable therewith when the lid is moved to a closed position. A flexible bridge extends between the base and the lid. One of the first or second sealing members is a protrusion and the other is a second channel. The protrusion may be received within the second channel when the lid is closed. Pressure may be progressively applied to the lid to zipper the cover into a sealed position. When the lid is in the sealed position material cannot be accidentally or purposefully removed from the interior chamber of the container In one aspect, the invention may provide a cover for use in sealing a container that has a side wall with an upper rim; said cover comprising a base having an upper end and a lower end; an opening defined by an inner surface of the base, wherein the opening extends between the upper and lower ends; a first sealing member provided on the base; a lid having a top wall and a side wall circumscribing the top wall; wherein the lid is movable between an open position and a closed position; and when the lid is in the closed position, access to the opening in the base is prevented; and when the lid is in the open position, access to the opening in the base is permitted; and a second sealing member provided on the lid; wherein the first sealing member and the second sealing member are engageable with each other when the lid is moved to the closed position.

In another aspect, the invention may provide 1 method of resealing a container containing a substance, wherein the container has a side wall with an upper rim; said method comprising steps of engaging a base of a sealing cover on the upper rim of the side wall of the container; moving a lid engaged with the base into a position vertically above the base; aligning a channel defined in one of the lid and the base with a protrusion provided on the other of the lid and the base; pushing the lid downwardly toward the base to engage the protrusion in the channel; progressively applying pressure to a perimeter of an outer surface of the lid; and sealing the lid and base together.

The step of engaging the base on the upper rim of the side wall of the container comprises positioning a channel defined in a lower end of the base over the upper rim; applying pressure to the base; and receiving the upper rim in the channel. Alternatively, the step of engaging the base on the upper rim of the side wall of the container comprises: overmolding the upper rim of the side wall of the container with the base. The step of positioning the lid over the base further comprises heat-sealing the lid to the base.

The method may further comprise steps of moving the lid to an open position to gain access to an interior chamber of the container; and moving the lid to a closed position to prevent access to the interior chamber. The method may further comprise folding a flexible bridge extending between the lid and base when the lid is moved to the closed position; and unfolding the flexible bridge when the lid is moved to the open position.

The method may further comprise breaking the sealing cover out of a blister pack comprising a sheet of material having a plurality of individual sealing covers formed therein; and applying the base of the single sealing cover removed from the blister pack to the side wall of the container after purchase of the container.

The method may further comprise applying the base to the side wall of the container after fabrication of the container but prior to purchase of the container.

In another aspect, the invention may provide in combination a container having a bottom wall and a side wall; said bottom and side walls bounding and defining an interior chamber adapted to hold a quantity of material therein; and a sealing cover that is selectively engageable with an upper rim on the side wall of the container; wherein the sealing cover comprises; a base that is engaged with the upper rim of the container; wherein the base has an upper end and a lower end; an opening defined by an inner surface of the base; a first sealing member provided on the base; a lid shaped and sized to close off access to the opening when the lid is positioned vertically above the base; and a second sealing member provided on the lid; said second sealing member being complementary to the first sealing member and being engageable with the first sealing member; a flexible bridge extending between the base and the lid; wherein the lid is movable relative to the base between an open position and a closed position; and when the lid is in the closed position the first and second sealing members seal the container against material being accidentally or purposefully removed from the interior chamber. The first or second sealing members may be received within the other of the first or second sealing members.

BRIEF DESCRIPTION OF THE SEVERAL VIEWS OF THE DRAWINGS

A sample embodiment of the invention is set forth in the following description, is shown in the drawings and is particularly and distinctly pointed out and set forth in the appended claims.

Similar numbers refer to similar parts throughout the drawings.

DETAILED DESCRIPTION

Referring to FIGS. 1A-5 there is shown a first embodiment of a sealing cover in accordance with an aspect of the invention, generally indicated at 10. As best seen in FIG. 1B, sealing cover 10 may comprise a base 28 and a lid 32 that are engaged with each other via a flexible hinge or bridge 24. Bridge 24 may be integrally formed with base 28 and lid 32 or may be a separate component that is heat welded or otherwise connected to base 28 and to lid 32.

Figure 2A:
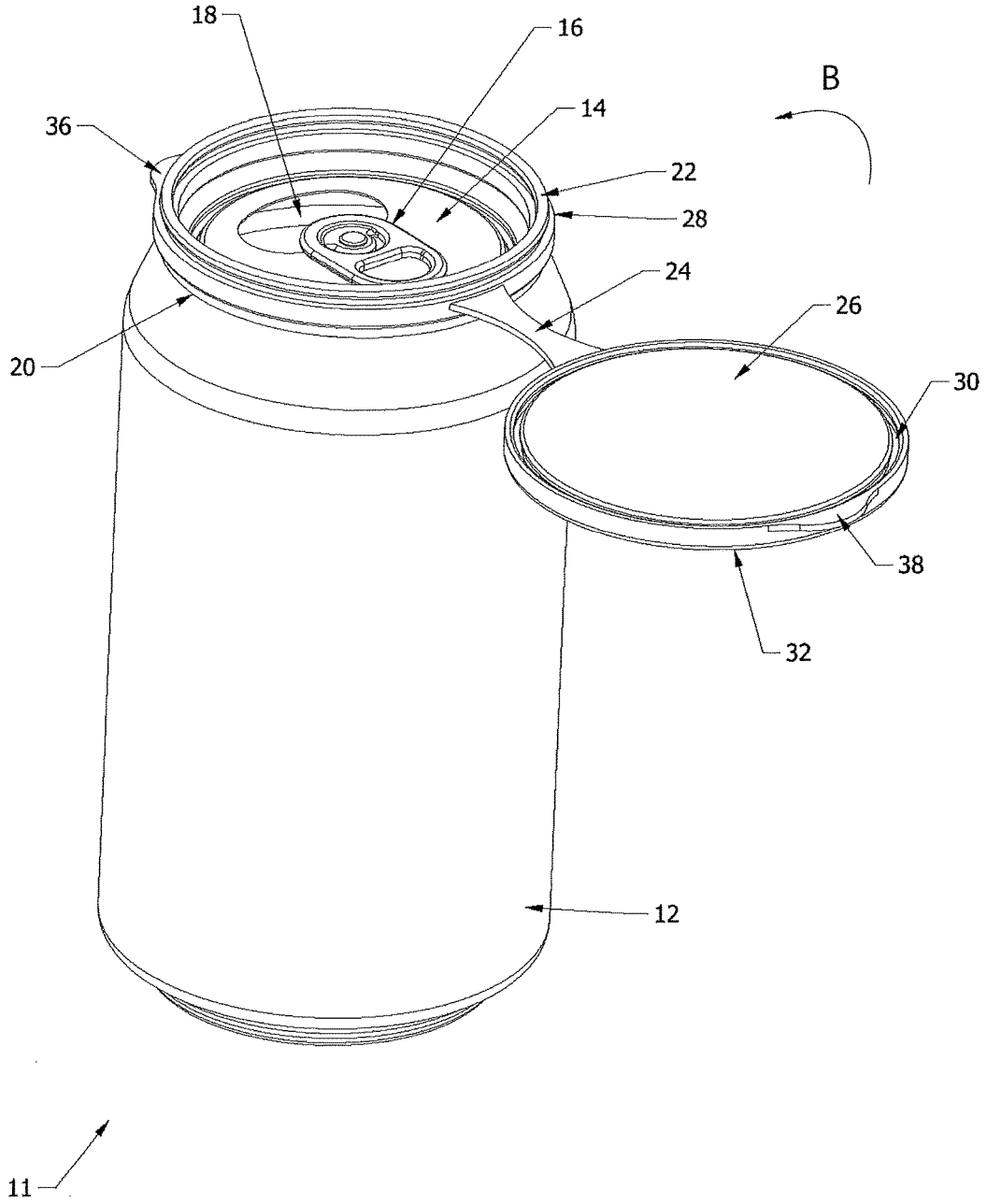
FIG. 2A is a perspective view of the cover shown engaged on a soda can with the cover moved to an open position.
Figure 2B:
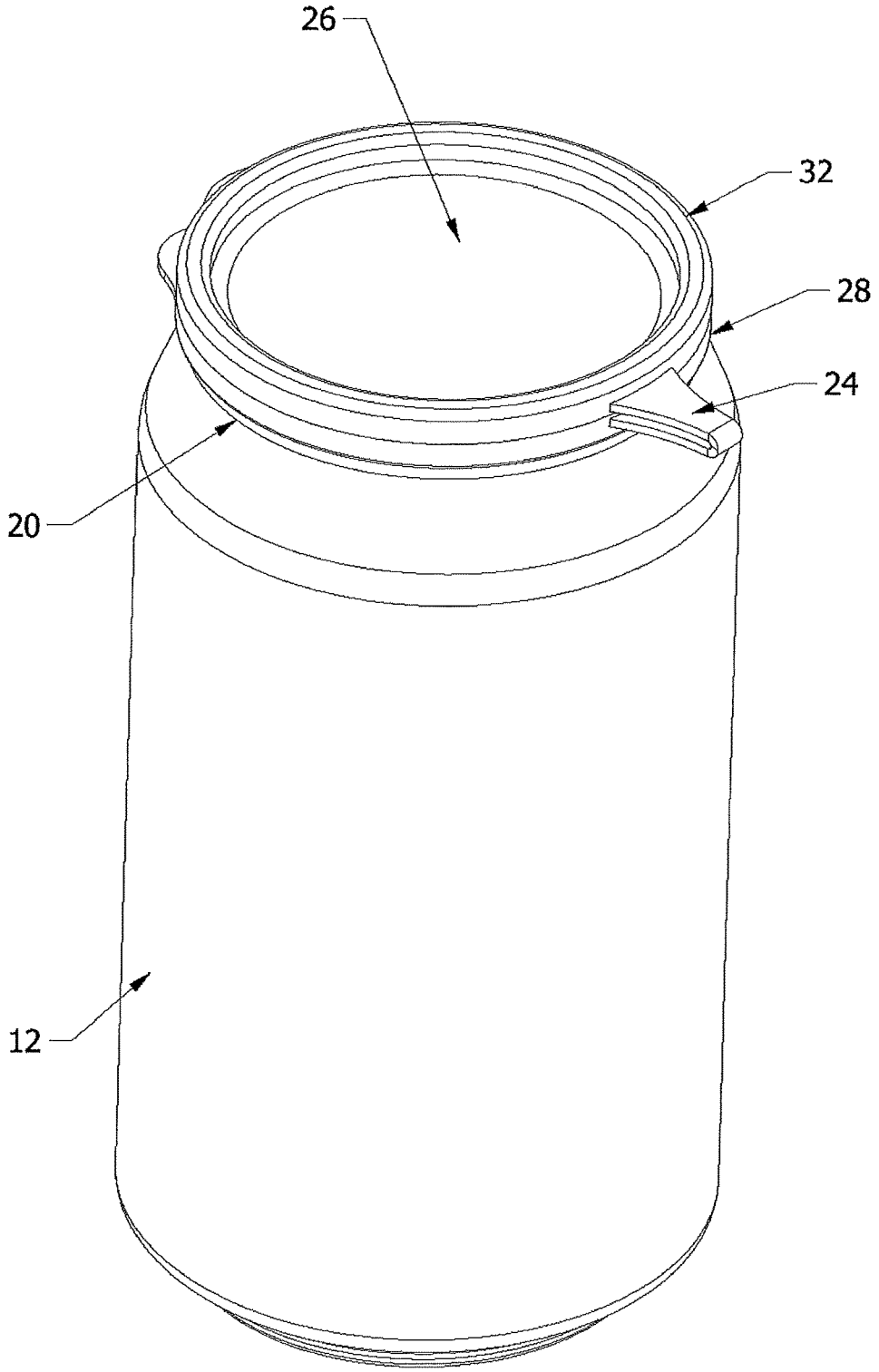
FIG. 2B is a perspective view of the cover shown engaged on a soda can and moved to a closed position.

Base 28 may be configured to be engaged with an upper rim of a beverage container 12 (FIG. 2A). Lid 32 may be movable about bridge 24 and relative to base 28 between an open position (FIG. 2A) and a closed position (FIG. 2B). When lid 32 is in the open position the contents of beverage container 12 may be accessed. When lid 32 is in the closed position, the contents of beverage container 12 may not be accessed. Sealing cover 10 will be described in greater detail below.

Figure 3A:
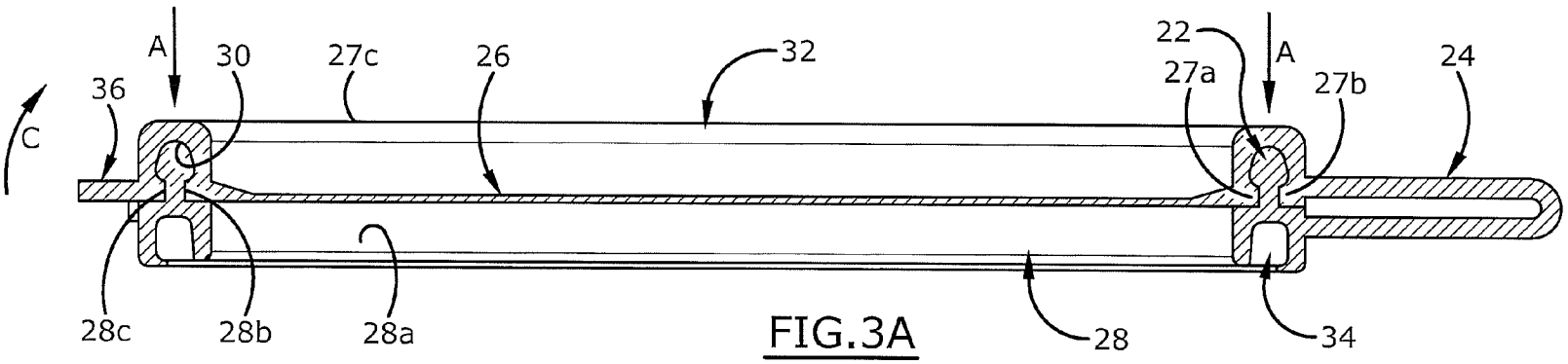
FIG. 3A is a cross-section of the cover shown on its own and in a closed position.

It should be noted that when cover 10 is in the closed position, lid 32 is located vertically above and aligned with base 28. The bridge 24 that extends between lid 32 and base 28 may be folded back upon itself as shown in FIG. 3A. When lid 32 is moved to the open position, i.e., out of vertical alignment with base 28, bridge 24 unfolds to the position shown in FIG. 1B.

It will be understood that instead of a flexible or living hinge, bridge 24 may be replaced with any other type of hinge or connecting mechanism to secure lid 32 and base 28 together and prevent them from becoming detached from each other.

Sealing cover 10 may be fabricated from one or more plastic materials that are appropriate and approved for use in the food industry for coming into direct contact with solid or liquid foods and beverages. Suitable plastic materials for sealing cover 10 may include but not be limited to polypropylene, polyethylene, or polycarbonate.

Base 28 may comprise a wall shaped and sized to be complementary to the beverage container 12 with which sealing cover 10 is to be engaged. Since beverage container 12 is illustrated as being generally circular in shape when viewed from a top end (i.e., the end that includes the opening through which the contents of container 12 are accessed), the wall of base 28 may be generally circular in shape when viewed from above. This can be seen in FIG. 1B. If beverage container 12 is differently shaped, when viewed from a top end, such as being square, rectangular, oval, triangular, or any other unique shape or configuration; the wall of base 28 will be fabricated to be complementary in shape to that top end of the container 12.

Figure 1A:
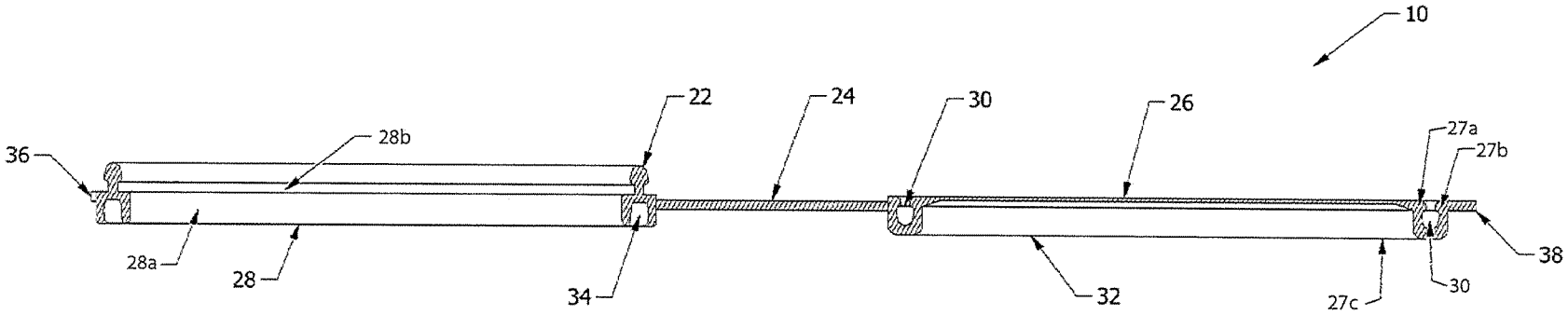
FIG. 1A is a side elevation view of a first embodiment of a sealing cover for a can in accordance with an aspect of the present invention, where the cover is shown in an open position.
Figure 1B:
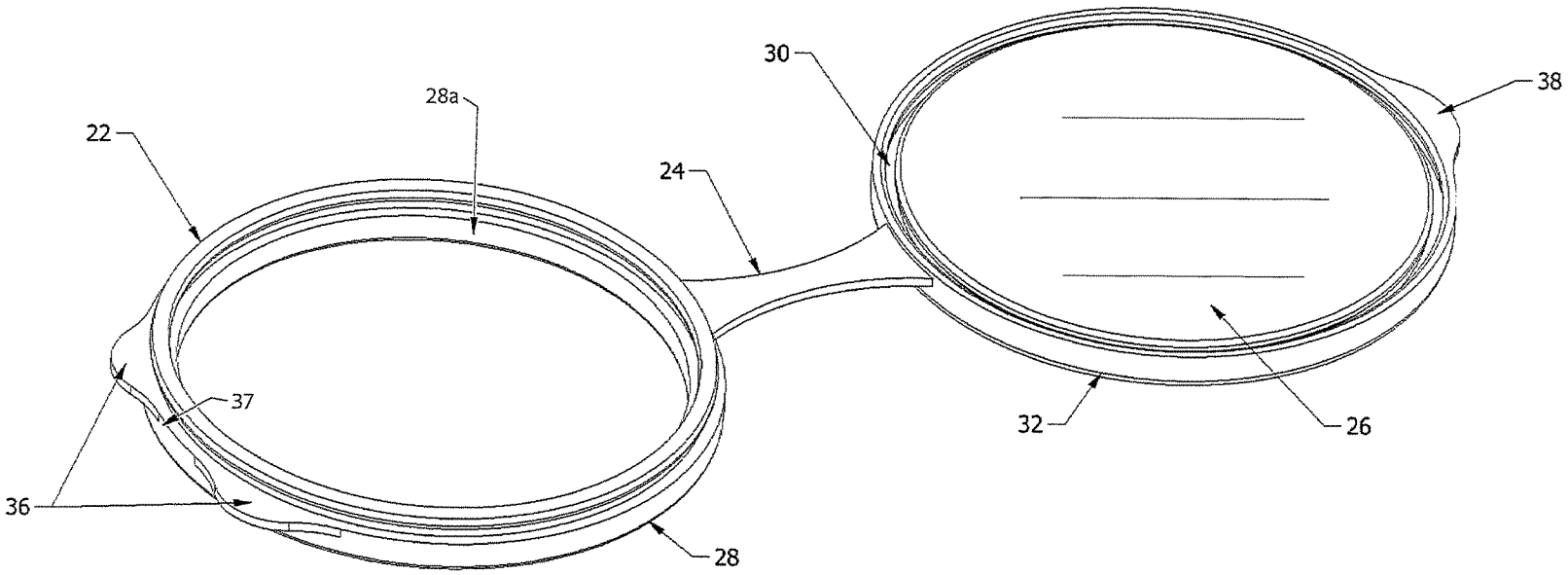
FIG. 1B is a perspective view of the cover of FIG. 1A.

An inner surface of the wall of base 28 bounds and defines an opening 28*a* through which the aperture defined in a top end of container 12 may be accessed. Opening 28*a* may extend from proximate an upper end of the wall to proximate a lower end of the wall. A first sealing member may be provided on base 28. As shown in FIG. 1B, the first sealing member may comprise a protrusion 22 provided on base 28. Protrusion 22 may be provided on an upper end of base 28 and may be shaped as a generally circular projection (FIG. 1A) that extends upwardly and outwardly from the upper end of the wall. Protrusion 22 may be an annular protrusion that is provided along substantially the entire circumference of the wall of base 28. It will be understood that protrusion 22 may be provided anywhere else on the wall of base 28 that will allow base 28 to be latched and ultimately sealed to lid 32.

A lower end of the wall of base 28 defines a first channel 34 that may extend along substantially the entire circumference of the wall. First channel 34 may be configured to be complementary to a rim 12*a* (FIG. 4A) provided on container 12. FIG. 3A shows that first channel 34 may be defined by a generally U-shaped region of the lower end of the wall of base 28. When sealing cover 10 is engaged with container 12, rim 12*a* is snugly received within first channel 34 of base 28 and base 28 is retained on rim 12*a* by friction. Base 28 of cover 10 may be snap-fitted onto the rim 12*a* of container 12 after a consumer has purchased the container 12 and the cover 10.

The inner surface of the wall of base 28 may also define an annular first groove 28*b* (FIG. 3A) that may extend around substantially the entire circumference of the wall. The outer surface of the wall of base 28 may also define an annular second groove 28*c* that may extend around substantially the entire circumference of the wall. Annular first and second grooves 28*b*, 28*c* may be provided proximate a lowermost region of protrusion 22. Grooves 28*b*, 28*c* ensure that protrusion 22 is able to flex from side-to-side during engagement of lid 32 with base 28 and during the progressive sealing of cover 10.

One or more first flanges 36 (FIG. 1B) may extend radially outwardly from the outer surface of the wall of base 28. FIG. 1B shows two first flanges 36 that are laterally spaced a distance apart from each other and define a recessed region 37 between them.

Lid 32 or at least a portion of lid 32 may be configured to be complementary in shape and size to base 28. So, as is illustrated in FIG. 1B, if base 28 is configured to be substantially circular in shape when viewed from above, then lid 32 or at least a portion of lid 32 may be substantially circular in shape. Obviously, if base 28 is differently configured, such as being square, rectangular, oval, elliptical, triangular or any other shape when viewed from above, then lid 32 or at least a portion of lid 32 may be substantially similarly configured.

Lid 32 comprises a top wall 26 and an annular wall 27 that circumscribes top wall 26. Annular wall 27 defines a second channel 30 in a location that is complementary to the location of protrusion 22 on base 28. As illustrated, second channel 30 may be provided on a lowermost surface of annular wall 27. In accordance with an aspect of the invention, second channel 30 may be defined to be complementary in shape, size and location to protrusion 22 provided on base 28. When lid 32 is positioned vertically above and aligned with base 28 by moving lid 32 to the closed position (FIG. 3A), protrusion 22 may be snugly received in second channel 30 of lid 32 and be retained therein by friction. Lid 32 and base 28 may initially be latched together by protrusion 22 entering channel 30. However, lid 32 and base may subsequently be progressively sealed and thereby locked together in such a manner that even liquid may tend not to flow out of the sealed container 12. This will be described later herein.

FIG. 3A shows that annular wall 27 (or top wall) of lid 32 defines a first annular shoulder 27*a* that is complementary shaped and sized to be received in first groove 28*b* of base 28; and defines a second annular shoulder 27*b* that is complementary shaped and sized to be received in second groove 28*c* of base 28.

A second flange 38 may extend radially outwardly from an exterior surface of annular wall 27. Second flange 38 may be located in such a way on annular wall 27 that when lid 32 is moved to a closed position, second flange 38 is located laterally adjacent at least one of the first flanges 36. Preferably, second flange 38 may be seated in the recessed region 37 defined between the two first flanges 36.

A first end of flexible bridge 24 may integrally formed with an exterior surface of base 28 and a second end of flexible bridge 24 may be integrally formed with an exterior surface of lid 32. As shown in FIG. 1B, a middle region of flexible bridge 24 may be narrower in width than either of the first end or second end thereof. Additionally, flexible bridge 24 is relatively thin and is therefore more readily able to flex and bend or fold over on itself.

Sealing cover 10 may be formed as an individual component (FIG. 1B) that may be snap fitted onto beverage container 12 or any other type of can after the production of container and the purchase thereof by a consumer. So, a user may purchase sealing cover 10 and beverage container 12 separately, and engage sealing cover 10 on the rim 12*a* of container 12 either before container 12 is opened or after container 12 is opened.

FIG. 2A shows a pull tab 16 on a top wall 14 of container 12 has been moved to an open position to provide access to an aperture 18 into the interior of container 12. A person may drink from container 12 or pour some of the contents thereof out through aperture 18 and then move sealing cover from the open position shown in FIG. 2A to the closed position shown in FIG. 2B. This is accomplished by rotating lid 32 in the direction of arrow "B" (FIG. 2A) to bring second channel 30 on lid 32 into alignment with protrusion 22 on base 28.

Once lid 32 is moved to the closed position, a user may initially align first second channel 30 with protrusion 22 and press downwardly in the direction of arrow "A" (FIG. 3). This will cause protrusion 22 to at least partially enter into first second channel 30 thereby latching lid 32 to base 28. In order to ensure a close sealing engagement between lid 32 and base 28, the user may then progressively run his or her finger along the perimeter of the upper edge 27*c* of annular wall 27, and around the circumference thereof, applying a gentle downward pressure in the direction of arrow "A". This motion will cause lid 32 to be progressively sealingly engaged with base 28 in a zipper type closure where protrusion 22 more or less fully enters into the complementary channel 30. This progressively application of pressure may ensure a tight seal between lid 32 and base 28. Because of the flexibility of the material used to fabricate sealing cover 10 and because of the side-to-side flexibility of protrusion 22 created by grooves 28*b*, 28*c*; lid 32 and base 28 are sealingly engaged with each other.

Figure 4A:
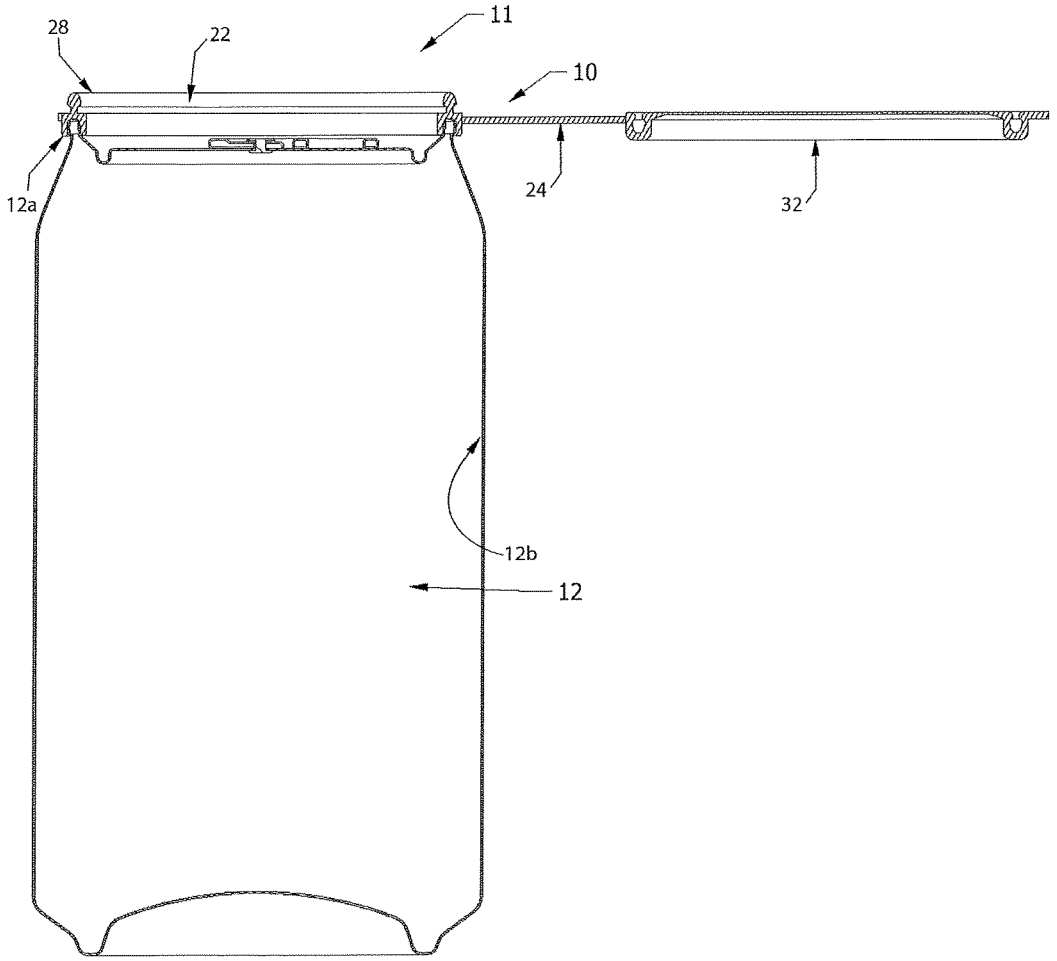
FIG. 4A is a cross-section of the cover shown engaged on a soda can and in an open position.
Figure 4B:
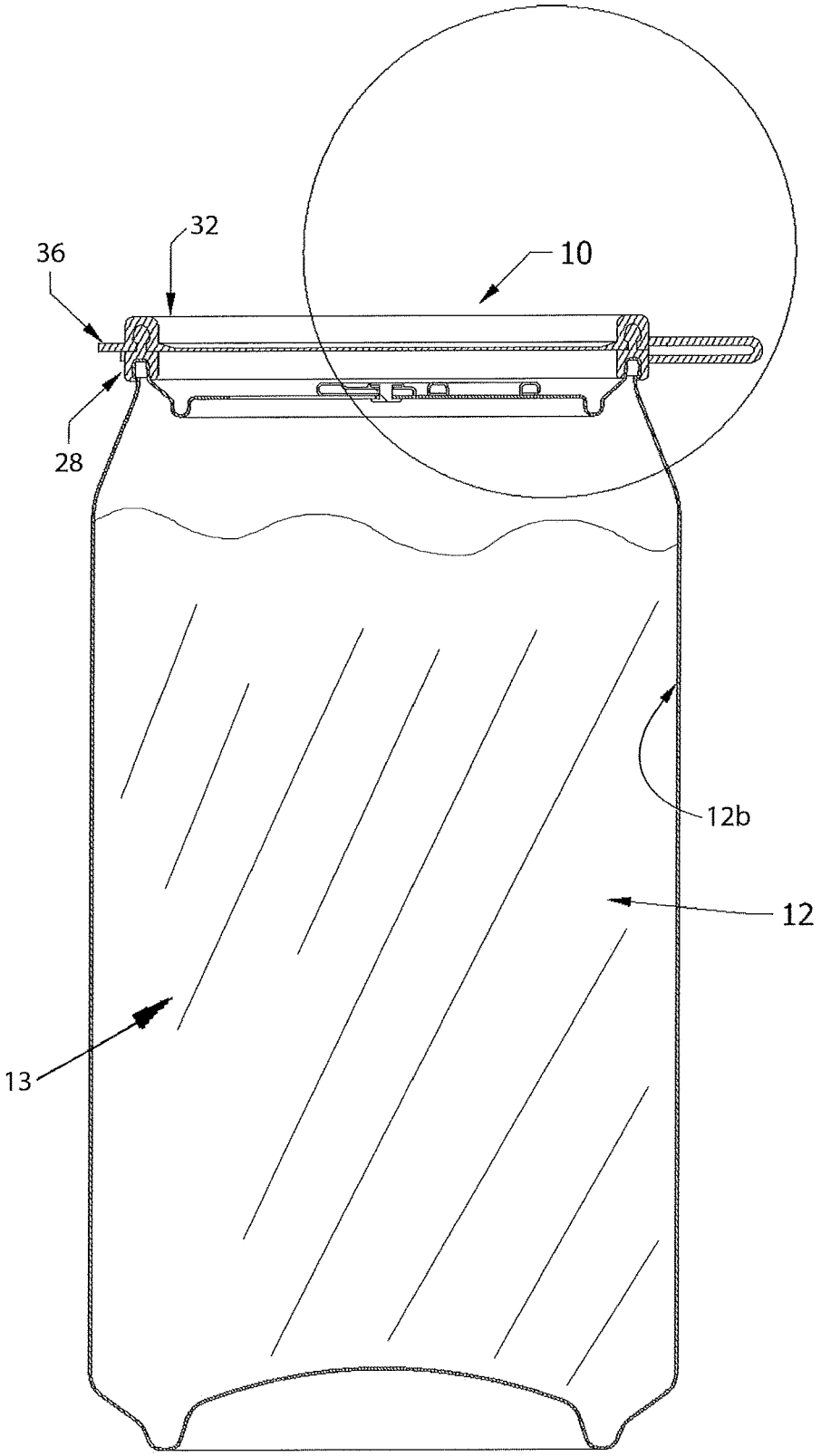
FIG. 4B is a cross-section of the cover shown engaged on a soda can and in a closed position.
Figure 5:
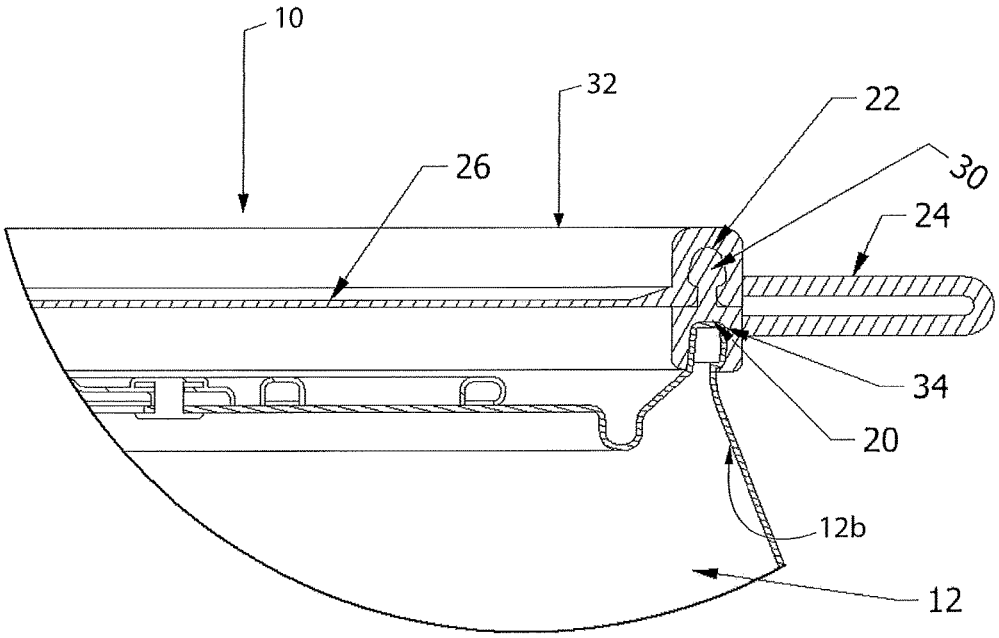
FIG. 5 is an enlarged cross-section of the highlighted region of FIG. 4B.

During the sealing engagement of lid 32 and base 28, annular shoulder 27*a* on lid 32 enters into annular first groove 28*b* on base 28, thereby ensuring a close seal between lid 32 and base 28. This is shown in FIG. 4B where it can be seen that sealing cover 10 closes off access to the interior chamber 12*b* and thereby to the contents 13 retained therein. (The interior chamber 12*b* of container 12 is bounded and defined by the bottom wall and side wall of the container 12. An opening to the interior chamber 12*b* is provided at an end of the container opposite bottom wall. The opening may comprise a small region of a top wall of the container or the entire top wall may be omitted in which case the opening is bounded by an upper rim of the side wall of the container.)

Figure 3B:
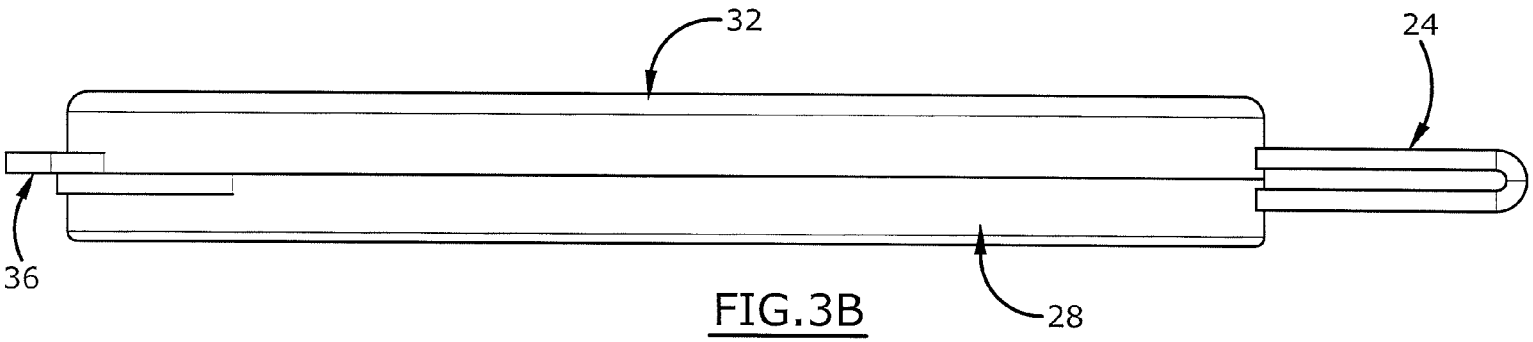
FIG. 3B is a side elevation of the cover of FIG. 3A.

If a user later decides he or he wishes to gain access to the contents 13 in the interior chamber 12*b* (FIG. 4A) of container 12, he or she will engage first flange 36 with their finger and will push upwardly thereon in the direction of arrow "C" (FIG. 3B). This motion will move sealing cover 10 back into the open position shown in FIG. 4A.

Figure 6A:
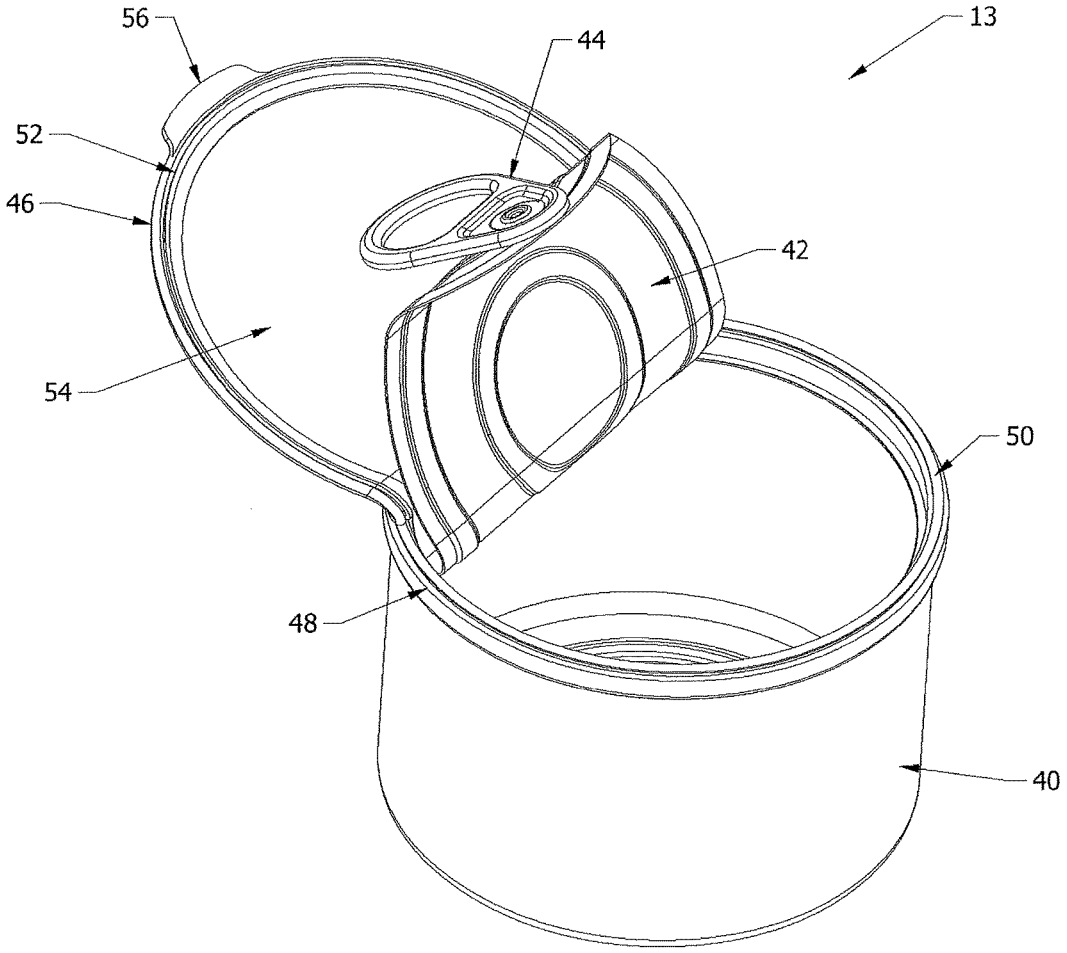
FIG. 6A is a top perspective view of a second embodiment of a sealing cover shown engaged on a food container with the cover in an open position and showing the lid of the food container being removed while the cover remains engaged with the food container.
Figure 6B:
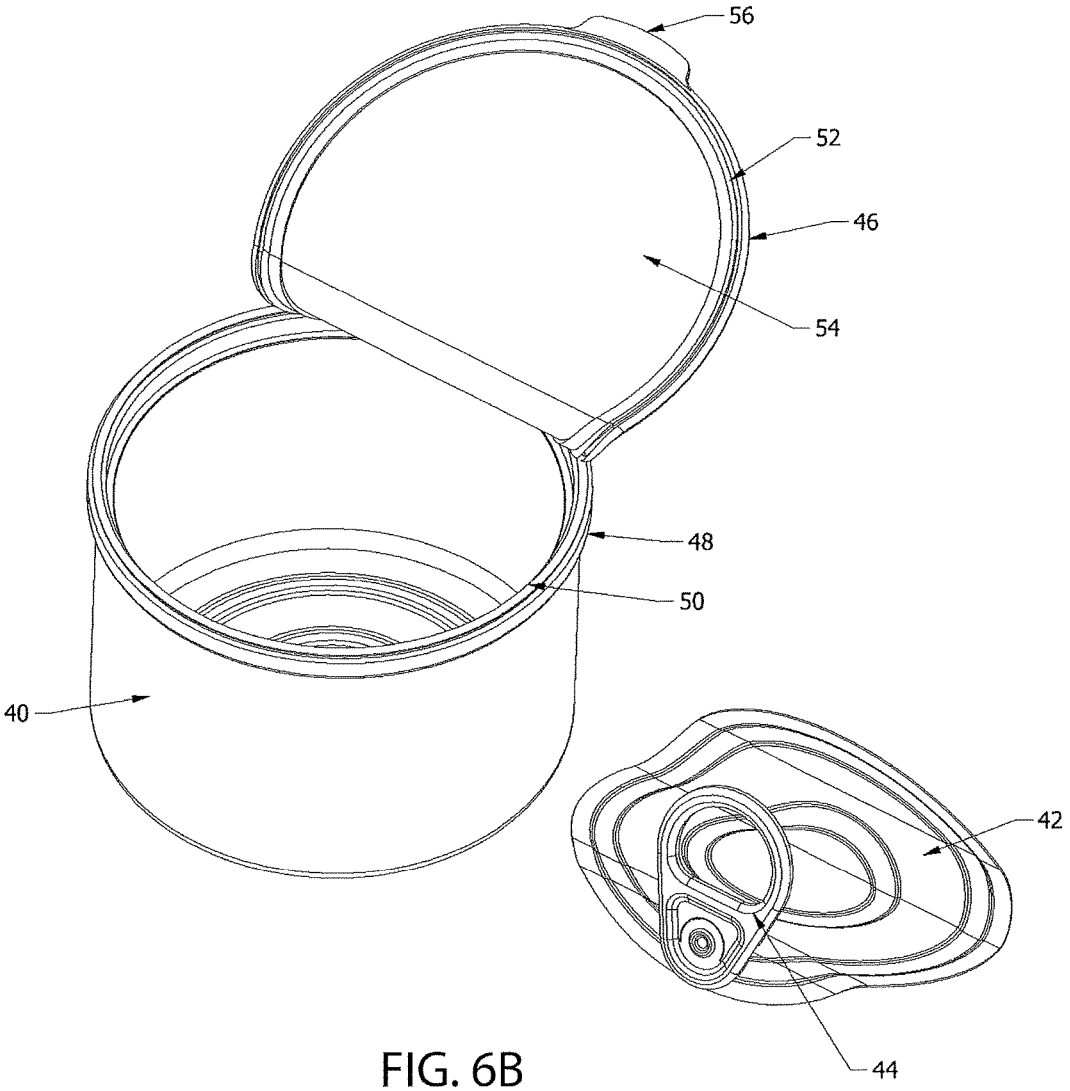
FIG. 6B is a top perspective view of the cover and food container of FIG. 6A where the lid of the food container has been completely removed from the food container while the cover remains engaged with the food container.

A method of resealing a container 12 in accordance with an aspect of the present invention, where the container 12 contains a substance, such as a beverage, food or another material in the interior chamber 12*b* thereof, and wherein the container has a side wall with an upper rim 12*a*, may comprise steps of engaging a base 28 of a cover 10 on the upper rim 12*a* of the side wall of the container 12; moving a lid 32 engaged with base 28 into a position vertically above base 28 (such as is shown in FIG. 4B); aligning a channel 30 (FIG. 1A), (or 52 (FIG. 6B) or 120 (FIG. 9)) defined in one of lid 32 and base 28 with a protrusion 22 (FIG. 1A) (or 50 (FIG. 6B or 122 (FIG. 9)) provided on the other of the lid and the base; pushing the lid 32 downwardly in the direction of arrow "A" (FIG. 3A) toward the base to engage the protrusion in the channel; progressively applying pressure (by way of a fingertip) to a perimeter of an outer surface of the lid; and sealing lid 32 and base 28 together.

Figure 6C:
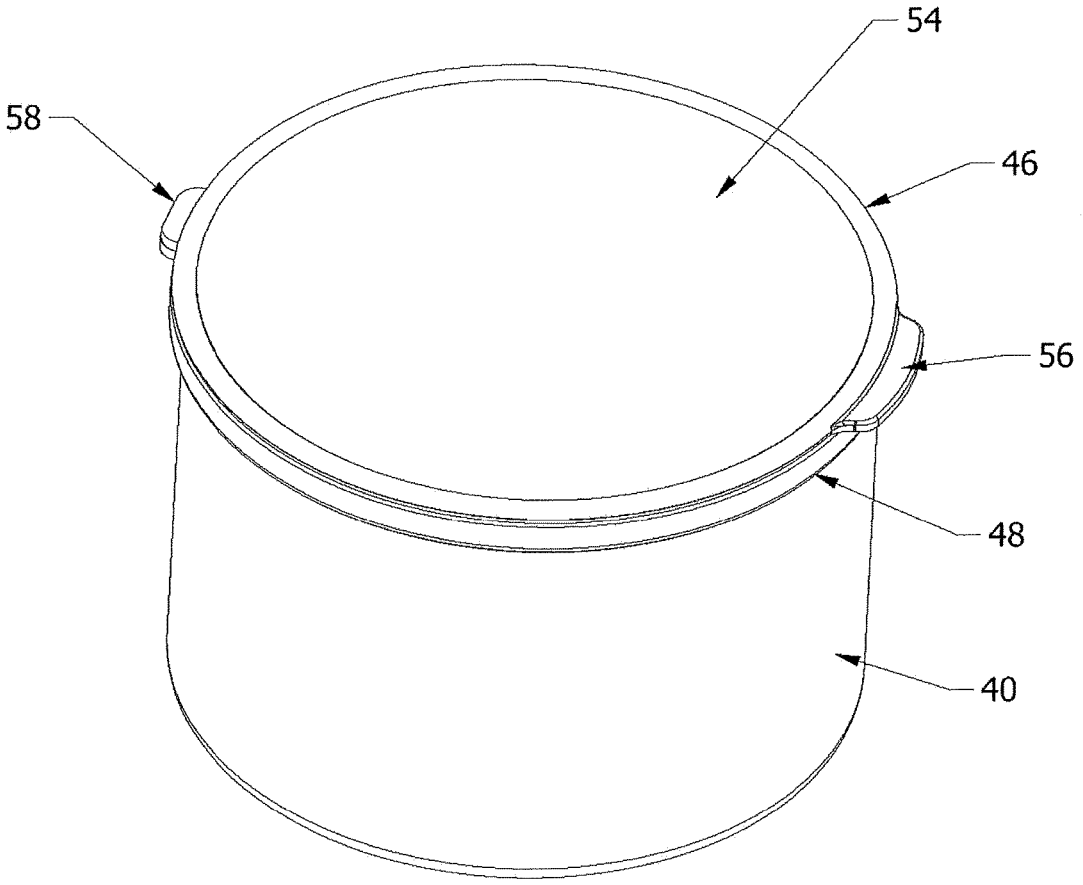
FIG. 6C is a top perspective view of the cover and the food container where the cover has been moved to a closed position to close off access to the interior of the food container.

FIGS. 6A to 6C show a second embodiment of a sealing cover in accordance with an aspect of the present invention, generally indicated at 54. Cover 54 is illustrated as being engaged with a can 40 such as a can of pet food. Can 40 includes a side wall that has a rim at an upper end thereof. Sealing cover 54 comprises a base 48 and a lid 46 that may be fabricated as separate components. After fabrication of can 40, a small and inexpensive addition is made to can 40 in the form of overmolding the rim of side wall 41 with base 48. Base 48 and lid 46 are assembled with lid 46 positioned on top of base 48 and the two components are heat-sealed together, such as at molded tabs 56 and 58 (FIG. 6C). (t will be understood that any other suitable method of securing or welding the plastic base 48 and lid 46 may be utilized instead of heat-sealing.)

FIG. 6A shows lid 46 rotated into an open position and the can's lid 42 in an open position. The can's lid 42 is moved to the open position by pulling on the pull tab 44. FIG. 6B shows the can 40 with the can's lid 42 completely disengaged from the can and the sealing cover 54 in the open position. It should be noted that after sealing cover 54 is moved to the open position, the can 40 may be opened and the can's lid 42 completely detached from the can without removing sealing cover 54 from its engagement with can 40. FIG. 6C shows lid 46 of sealing cover 54 moved to a closed and sealed position. Lid 46 is rotated into the closed position such that the protrusion 50 on base 48 is received in the channel 52 on lid 46. Lid 46 is initially latched by pushing downwardly thereon and then the user will run their finger around the perimeter of lid 46 progressively pushing downwardly to zipper lock lid 46 to base 48 in the same manner as lid 32 is locked to base 28. Cover 54 may easily be opened by engaging tab 56 and pushing upwardly thereon.

If the user does not wish to reseal can, lid 46 may be disengaged from base 48 by applying a pulling force thereto to break the seal at tab 58.

The can 40 will be purchased by the consumer looking the same way as is illustrated in FIG. 6C, i.e., in a closed position. Cover 54 keeps the can's lid 42 in a sanitary condition by preventing dust, dirt, debris etc. from accumulating on lid 42. Allowing dust, dirt, debris, etc. to accumulate on a can lid may present a health and safety hazard for consumers. Cans stored in warehouses, factories and shops may be exposed to mice and other rodents and there have been documented cases of *E. coli* contamination from consumers drinking directly from soda cans. Sealing cover 54 provides an inexpensive option to aid in preventing the can's lid 40 from being contaminated. Additionally, if the can 40 is a soda can, it is easy for the consumer to prevent bees and other insects from entering into can 40 when the consumer is not actively drinking therefrom by simply pushing lid 46 into the closed position. If the consumer desires to access the contents at a later time, the lid 46 may then be moved to the sealed and position by running their finger around the perimeter of lid 46 and gently applying pressure thereto.

Figure 7:
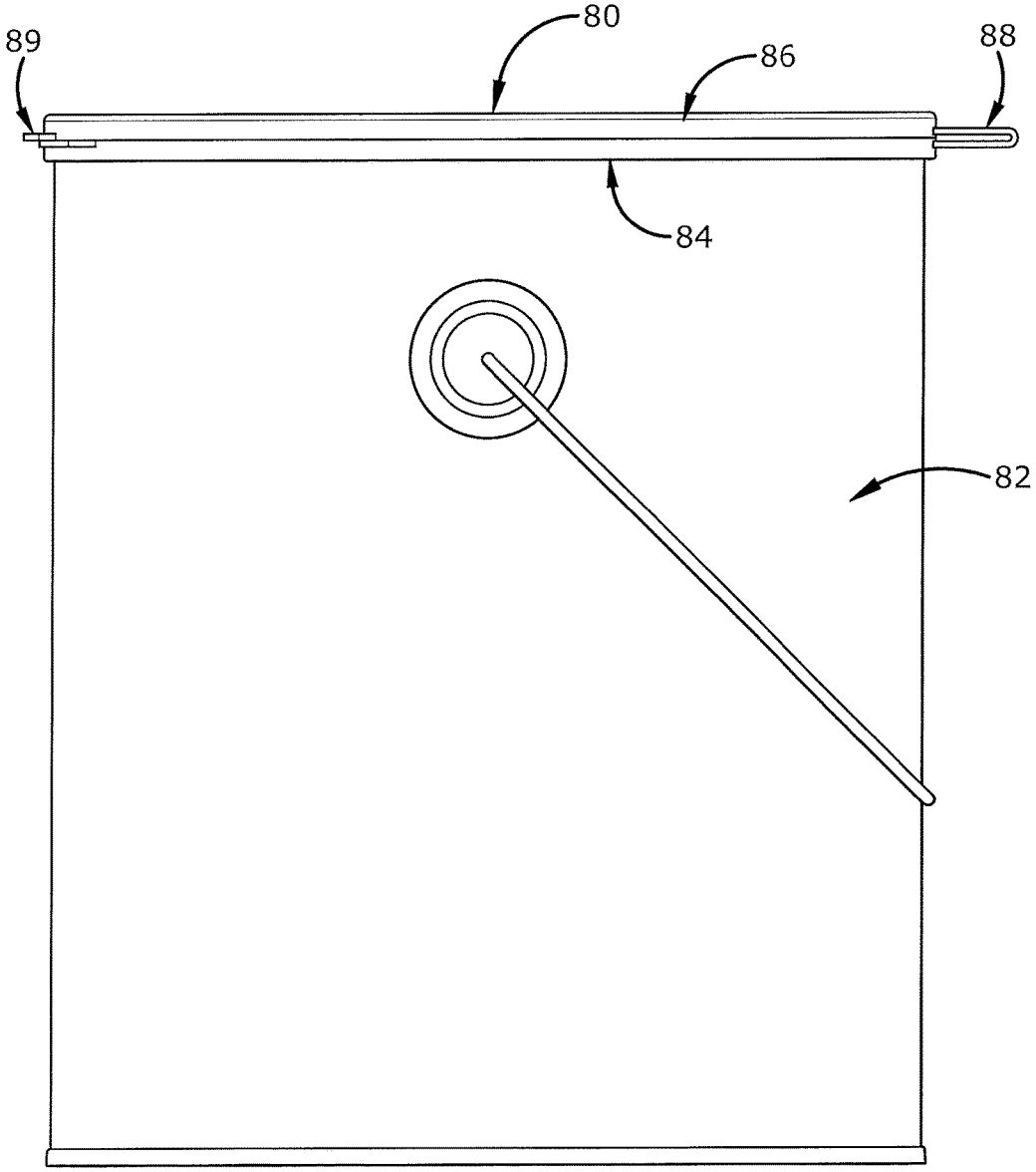
FIG. 7 is a side elevation view showing the sealing cover of the present invention engaged on a paint can.

FIG. 7 illustrates a sealing cover 80 in accordance with an aspect of the present invention being used on a paint can 82. Cover 80 includes base 84 and lid 86 that are engaged with each other via a flexible bridge 88. Cover 80 may be substantially identical to cover 10 and therefore will not be described in any more detail herein. Base 84 may be engaged on a rim at an upper edge of the side wall of paint can 82 and lid 86 may selectively be moved between the open and closed positions in a similar manner as with the first and second embodiments described herein. Cover 80 may be provided as an aftermarket product that is purchased separately and then engaged by the consumer on paint can 82 in a similar manner to cover 10. Alternatively, cover 80 may be applied in the factory after fabrication of the paint can 82 by overmolding base 84 and then heat-sealing lid 86 thereto in a similar manner to cover 54.

In use, lid 86 will be moved to the open position in order to gain access to the paint within paint can 82. When the consumer wishes to close and seal paint can 82 to prevent the paint from drying out or from becoming contaminated, lid 86 is moved to the closed position by pushing downwardly thereon until a protrusion on the base 84 is received in a channel on the lid 86. This latches lid 86 to base 84. The consumer will then push downwardly and move their finger along the top surface of the lid 86 and around the perimeter thereof to progressively zipper lid 86 closed to base 84. A flange 89 on lid 86 may be engaged and pushed upwardly to reopen lid 86 at a later time.

It will be understood that the sealing cover disclosed herein is contemplated to be fabricated in any size or shape and to be used on cans or containers that contain any type of product, but particularly food and beverages.

Figure 8:
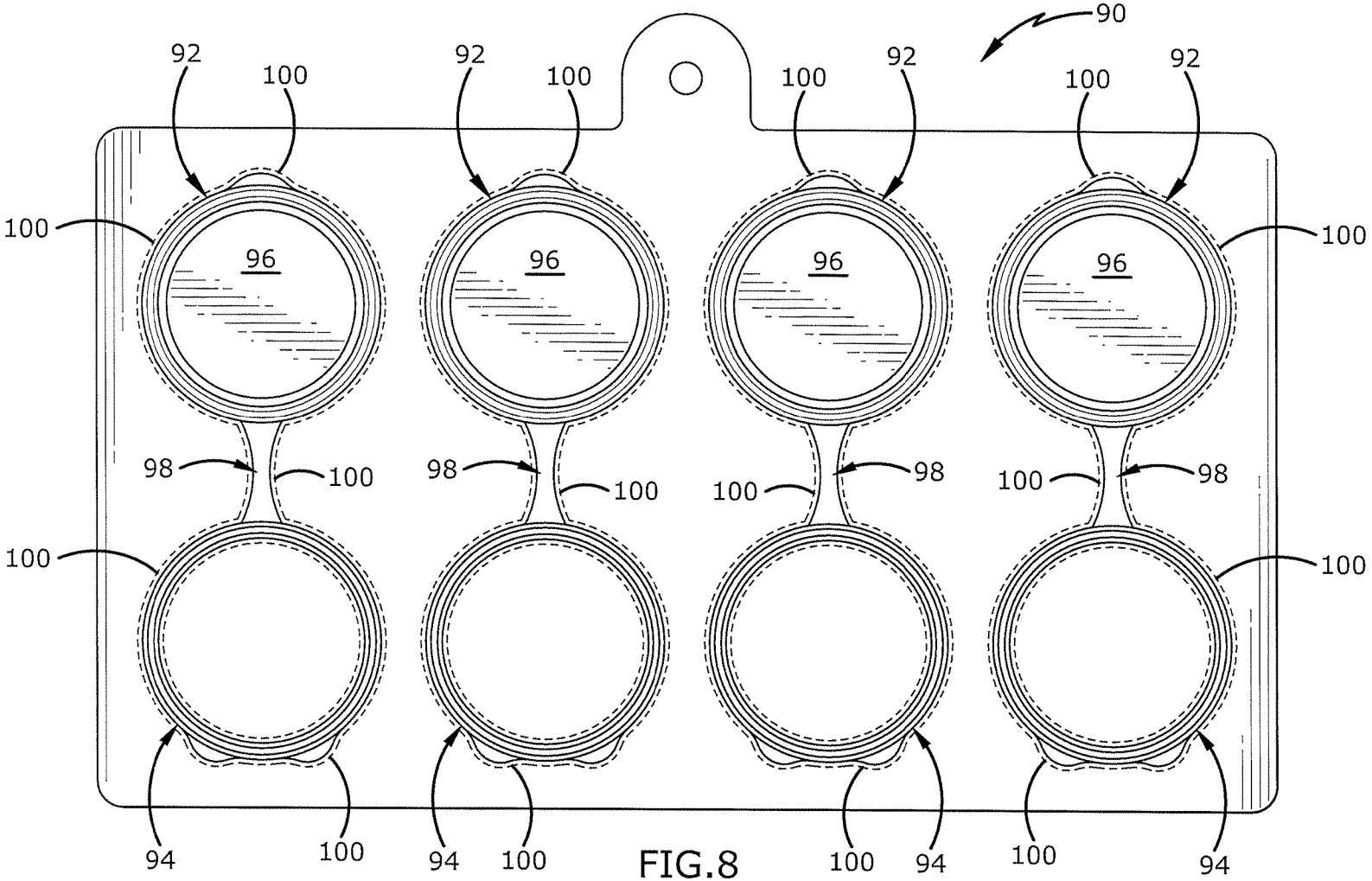
FIG. 8 is a top plan view of a blister pack showing multiple individual sealing covers provided in the blister pack; which sealing covers may selectively be removed from the blister pack for engagement with a can or beverage container.

FIG. 8 shows a blister pack 90 that includes a sheet of material into which a plurality of sealing covers 92 are molded or stamped therein. Each sealing cover 92 comprises a base 94, a lid 96 and a flexible bridge 98 extending therebetween. The consumer may purchase blister pack 90 and selectively remove the sealing cover 92 therefrom for use. The single sealing cover 92 is removed from the rest of blister pack 90 by pushing on the lines of weakness 100 that circumscribe that particular sealing cover 92. The detached sealing cover 92 may then be used in a similar manner to sealing cover 10. Blister pack 90 may contain one or more sealing covers 92 thereon that may be individually detached from blister pack 90.

Figure 9:
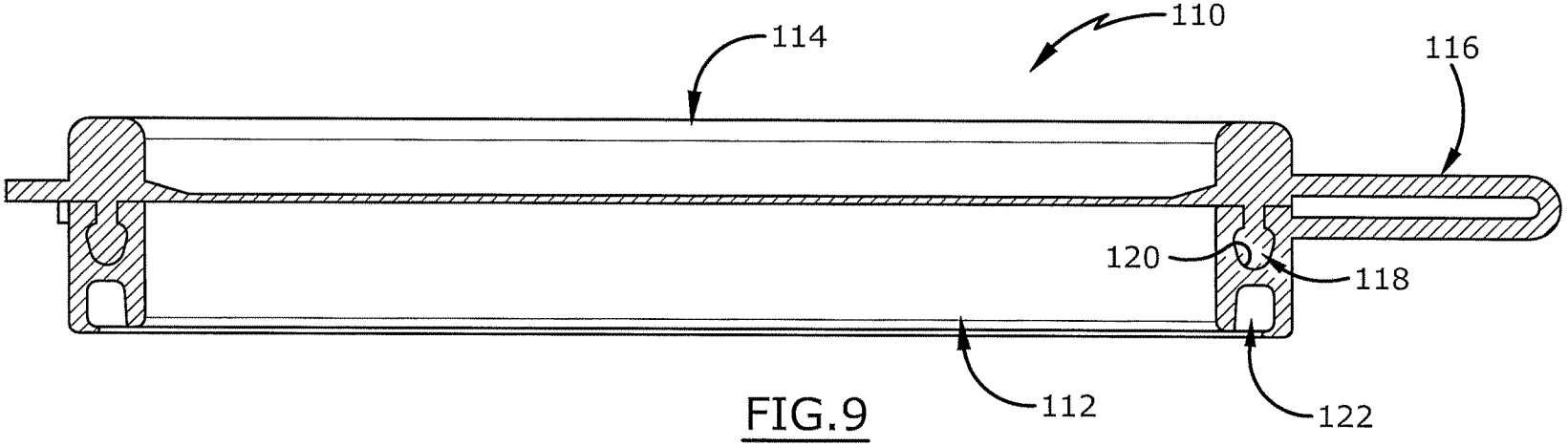
FIG. 9 is a side elevation view of a third embodiment of a sealing cover in accordance with an aspect of the invention.

FIGS. 1-6C show that the protrusion 22 or 50 may be provided on base 28 or 48, respectively; and that second channel 30 or 52 may be provided on lid 32 or 54, respectively. FIG. 9 shows a third embodiment of the sealing cover, generally indicated at 110. Sealing cover 110 may comprises a base 112 and a lid 114 that are connected together by a flexible bridge or living hinge 116. Cover 110 may be substantially identical to cover 10 with the exception that a protrusion 118 is provided on an underside of lid 114 and a second channel 120 is defined in the upper side of base 112. The cover 110 is engaged with a can or container by a rim on an upper end of the can or container being received in a complementary first channel 122 provided on a lower end of base 112. Base 112 and lid 114 of cover 110 may be latched and subsequently progressively sealed together in substantially an identical manner to the base and lid of cover 10.

It will be understood that while this invention has been described mainly for use in conjunction with a metal can or container, the sealing covers disclosed herein may be engaged with the rims of glass or plastic jars or bottles or any other types of containers no matter the type of material from which those containers are fabricated.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the preferred embodiment of the disclosure are an example and the disclosure is not limited to the exact details shown or described.

The invention claimed is:

1. A cover for use in sealing a container that has a side wall with an upper rim; said cover comprising:

a base having an upper end, a lower end, and an inner side surface that extends between the upper end and the lower end, wherein the inner side surface bounds and defines an opening; wherein the opening is adapted to provide access to a top end of a container with which the cover is selectively engaged;

a first channel defined in the lower end of the base; wherein the first channel is adapted to be complementary to an upper rim of the container and receives the upper rim of the container therein;

a first sealing member provided on the upper surface of the upper end of the base; wherein the first sealing member is vertically aligned with the first channel;

a lid having a top wall and a side wall circumscribing the top wall; wherein the lid is movable between an open position and a closed position; and when the lid is in the closed position, access to the opening in the base is prevented; and when the lid is in the open position, access to the opening in the base is permitted; and a second sealing member provided on a bottom surface of the lid; wherein the first sealing member and the second sealing member are vertically aligned with each other and with the first channel; and the first sealing member and second sealing member are engageable with each other when the lid is moved to the closed position; and wherein the first sealing member is a second channel and the second sealing member is a protrusion; and the protrusion is complementary to the second channel; and when the lid is moved to the closed position, the protrusion is received in the second channel.

2. The cover as defined in claim 1, wherein the second channel is an annular second channel defined in the upper surface of the upper end of the base; and the protrusion is an annular protrusion defined in the bottom surface of the lid.

3. The cover as defined in claim 1, further comprising a flexible bridge extending between the base and the lid.

4. The cover as defined in claim 3, wherein the bridge folds back upon itself when the lid is moved to the closed position and the bridge is unfolded when the lid is moved to the open position.

5. The cover as defined in claim 1, further comprising a first flange extending outwardly from an exterior surface of the base.

6. The cover as defined in claim 1, further comprising a second flange extending outwardly from an exterior surface of the base.

7. A method of resealing a container containing a substance, wherein the container has a side wall with an upper rim; said method comprising steps of:

engaging a first channel defined in a bottom surface of a base of a sealing cover on the upper rim of the side wall of the container;

moving a lid engaged with the base into a position vertically above the base;

aligning a second channel defined in one of the lid and the base with a protrusion provided on the other of the lid and the base; wherein the first channel, the second channel and the protrusion are all vertically aligned with each other when the bottom surface of the lid is positioned over a top surface of the base;

pushing the lid downwardly toward the base to engage the protrusion in the second channel;

progressively applying pressure to a perimeter of an outer surface of the lid;

sealing the lid and base together; and wherein the step of engaging the base on the upper rim of the side wall of the container comprises:

overmolding the upper rim of the side wall of the container with the base.

8. The method as defined in claim 7, wherein the step of engaging the base on the upper rim of the side wall of the container comprises:

positioning the first channel defined in the bottom surface lower of the base over the upper rim;

applying downward pressure to the base; and receiving the upper rim in the first channel.

9. The method as defined in claim 7, wherein the step of positioning the lid over the base further comprises:

heat-sealing the lid to the base.

10. The method as defined in claim 7, further comprising steps of:

moving the lid to an open position to gain access to an interior chamber of the container; and moving the lid to a closed position to prevent access to the interior chamber.

11. The method as defined in claim 10, further comprising:

folding a flexible bridge extending between the lid and base when the lid is moved to the closed position; and unfolding the flexible bridge when the lid is moved to the open position.

12. The method as defined in claim 7, further comprising:

breaking the sealing cover out of a blister pack comprising a sheet of material having a plurality of individual sealing covers formed therein; and applying the base of the sealing cover removed from the blister pack to the side wall of the container after purchase of the container.

13. The method as defined in claim 7, further comprising applying the base to the side wall of the container after fabrication of the container but prior to purchase of the container.

14. A cover for use in sealing a container that has a side wall with an upper rim; said cover comprising:

a base having an upper end, a lower end, and an inner side surface that extends between the upper end and the lower end, wherein the inner side surface bounds and defines an opening; wherein the opening is adapted to provide access to a top end of a container with which the cover is selectively engaged;

a first channel defined in the lower end of the base; wherein the first channel is adapted to be complementary to an upper rim of the container and receives the upper rim of the container therein;

a first sealing member provided on the upper surface of the upper end of the base; wherein the first sealing member is vertically aligned with the first channel;

a lid having a top wall and a side wall circumscribing the top wall; wherein the lid is movable between an open position and a closed position; and when the lid is in the closed position, access to the opening in the base is prevented; and when the lid is in the open position, access to the opening in the base is permitted; and a second sealing member provided on a bottom surface of the lid; wherein the first sealing member and the second sealing member are vertically aligned with each other and with the first channel; and the first sealing member and second sealing member are engageable with each other when the lid is moved to the closed position;

wherein the first sealing member is an annular protrusion defined in the upper surface of the upper end of the base and the protrusion extends vertically upwardly from the upper surface of the upper end of the base;

wherein the second sealing member is a second channel; and the second channel is an annular channel defined in the bottom surface of the lid; wherein the protrusion is complementary to the second channel; and when the lid is moved to the closed position, the protrusion is received in the second channel; and wherein the annular protrusion includes a shaft extending outwardly from the upper surface of the base; and wherein a pair of opposed annular grooves are defined in opposed side surfaces of the shaft; and wherein the lid further comprises an annular flange that is selectively receivable in each of the two annular grooves when the lid and base are engaged with each other.

* * * * *